US007913860B2

(12) United States Patent
Merl

(10) Patent No.: US 7,913,860 B2
(45) Date of Patent: Mar. 29, 2011

(54) GRAVITY-FED STORAGE AND DISPENSING UNIT

(76) Inventor: Milton J. Merl, New York, NY (US)

( * ) Notice: Subject to any disclaimer, the term of this patent is extended or adjusted under 35 U.S.C. 154(b) by 325 days.

(21) Appl. No.: 11/868,732

(22) Filed: Oct. 8, 2007

(65) Prior Publication Data

US 2009/0090739 A1 Apr. 9, 2009

(51) Int. Cl.
*A47F 1/04* (2006.01)
*A47F 7/00* (2006.01)

(52) U.S. Cl. ..... 211/59.2

(58) Field of Classification Search ..... 211/59.2, 211/74, 194, 10, 11, 183, 188, 201; 312/45, 312/72, 73, 35, 42, 60; 221/194, 67, 92; 248/309.1; D6/408, 515
See application file for complete search history.

(56) References Cited

U.S. PATENT DOCUMENTS

| | | | | | |
|---|---|---|---|---|---|
| 265,400 | A | * | 10/1882 | Fitch | 221/301 |
| 1,743,328 | A | * | 1/1930 | Dougherty | 221/311 |
| 2,122,322 | A | * | 6/1938 | Kidwell et al. | 211/59.2 |
| 2,125,000 | A | * | 7/1938 | Considine | 211/59.2 |
| 2,382,191 | A | * | 8/1945 | Weichselbaum | 312/45 |
| 2,852,327 | A | * | 9/1958 | Mason | 312/45 |
| 2,888,145 | A | * | 5/1959 | Knott et al. | 211/59.2 |
| 2,915,162 | A | * | 12/1959 | Umstead | 193/27 |
| 2,996,344 | A | * | 8/1961 | Garman | 312/45 |
| 3,286,846 | A | * | 11/1966 | Brandes | 211/59.2 |
| 3,318,455 | A | * | 5/1967 | Takahashi | 211/59.2 |
| 3,784,022 | A | * | 1/1974 | Beesley, Jr. | 211/59.2 |
| 4,105,126 | A | * | 8/1978 | Deffner et al. | 211/59.2 |
| 4,228,903 | A | * | 10/1980 | Eckert | 211/59.2 |
| 4,356,923 | A | * | 11/1982 | Young et al. | 211/59.2 |
| 4,474,297 | A | * | 10/1984 | Zucker | 211/59.2 |
| 4,997,106 | A | | 3/1991 | Rockola | |
| 4,998,628 | A | | 3/1991 | Ross | |
| 5,009,329 | A | | 4/1991 | Farrentine | |
| 5,078,459 | A | | 1/1992 | Sclater | |
| 5,080,256 | A | | 1/1992 | Rockola | |
| 5,228,590 | A | | 7/1993 | Blasko et al. | |
| 5,284,292 | A | | 2/1994 | Johnson | |
| 5,295,608 | A | | 3/1994 | Blasko et al. | |
| 5,356,033 | A | | 10/1994 | Delaney | |
| D354,181 | S | | 1/1995 | Smith et al. | |
| 5,390,821 | A | | 2/1995 | Markel | |
| 5,396,997 | A | * | 3/1995 | Johnson | 211/59.2 |
| 5,462,198 | A | | 10/1995 | Schwimmer | |
| 5,788,117 | A | | 8/1998 | Zimmanck | |
| 5,806,712 | A | * | 9/1998 | Siemsen et al. | 221/67 |
| 6,786,341 | B2 | * | 9/2004 | Stinnett et al. | 211/59.2 |
| 6,991,116 | B2 | | 1/2006 | Johnson et al. | |
| 7,207,447 | B2 | | 4/2007 | Medcalf et al. | |
| 2004/0200789 | A1 | | 10/2004 | Woodbury | |
| 2006/0278591 | A1 | | 12/2006 | Tippets et al. | |

* cited by examiner

*Primary Examiner* — Darnell M Jayne
*Assistant Examiner* — Stanton L Krycinski
(74) *Attorney, Agent, or Firm* — Ladas & Parry LLP

(57) ABSTRACT

A gravity-fed storage and dispensing unit featuring two sidewalls having opposed ledges which form a plurality of separated rearwardly-directed paths, a receiving bin area, and a forwardly-directed path for products to be stored and dispensed. Products placed on a loading area on the front side of the dispensing unit are pulled by gravity down the rearwardly-directed path, into a product receiving bin, and then travel together along the forwardly directed path in two rows. The products from the different rearwardly-directed paths are interspersed in the product receiving bin area. The sidewalls of the dispensing unit have bosses which receive divider rods of varying lengths so that the width of the paths can be adjusted. Multiple units may be attached to each other in an adjacent relationship.

15 Claims, 6 Drawing Sheets

GRAVITY-FED STORAGE AND DISPENSING UNIT

FIELD OF THE INVENTION

This invention relates generally to storage and dispensing units.

BACKGROUND OF THE INVENTION

Various assemblies have been created to store and dispense products, particularly in a retail sales environment. Gravity-fed dispensers are one type of dispensing assembly commonly used in retail outlets such as grocery stores, convenience marts and department stores. Gravity-fed dispensers work by loading products, such as canned products, on their sides at the top of a path having a declining slope and storing the cans along the path. The bottommost portion of the path has a dispensing region, usually forward facing, where a product is easily accessible to the customers. When the customer removes the product from the dispensing region, gravity forces the adjacent product farther down the path and into the dispensing region. Gravity-fed dispensers allow products to be stored and dispensed in a convenient and efficient manner.

One example of a gravity-fed dispenser is shown in U.S. Pat. No. 6,991,116 to Johnson. The Johnson device features a set of panels having curvilinear rails which define a plurality of downward-sloping paths oriented vertically to each other. A product travels down a path and is dispensed in a dispensing region on a forward facing portion of the unit.

In the Johnson device, the rails are configured so that the paths are separated from the other paths throughout the dispenser. Therefore, a product placed on one path remains on the path from the topmost loading portion of the path to the bottommost dispensing portion of the path.

A disadvantage of the prior art devices is that products that are positioned on different paths within the dispensing unit never get mixed. While prior art devices may be adapted to provide several products in the dispensing region, customers normally favor taking the product from one path. For instance, frequently the most forward facing product or the product on the bottom path are preferred to other accessible products. Accordingly, a disproportionate number of products are taken from one path. This prevents uniform distribution of the product inventory; the products on the other path tend to remain, while the products on the bottom path are restocked and thus are fresher. Due to the uneven distribution of product by such a dispensing unit, a store owner may have to dispose of older product and incur the costs associated therewith. Additionally, such dispensing units have to be checked and refilled frequently because one track is often emptied before all the products in the dispensing unit have been removed.

Gravity-fed dispensers known in the art generally have sidewalls displaced apart from each other at a fixed length. Therefore, the width of the paths defined by ledges on the sidewalls are fixed and can only accommodate products with a corresponding width. Therefore, with traditional gravity-fed dispensers, a store owner must purchase numerous units to accommodate products with different sizes and certain dispensers may become obsolete when a manufacturer changes the dimensions of a product packaging. Accordingly, it is desirable for the distance between sidewalls to be adjustable.

Accordingly, it is an object of the present invention to provide a gravity-fed storage and dispensing unit that provides multiple product dispensing paths and mixes products from each path together.

Yet another object of the present invention is to provide a gravity-fed storage and dispensing unit that distributes products uniformly.

It is another object of the present invention to provide a gravity-fed storage and dispensing unit having the aforesaid characteristics that is adjustable with respect to the distance between the sidewalls and the width of the paths for the product.

Still a further object of the present invention is to provide a gravity-fed storage and dispensing unit that can be assembled to add a plurality of additional gravity-fed storage and dispensing units in an adjacent relationship to each other.

A further object of the present invention is to provide a gravity-fed storage and dispensing unit that is efficient and cost effective to manufacture.

SUMMARY OF THE INVENTION

The foregoing objects are met by the present invention directed to an improved gravity-fed storage and dispensing unit. The storage and dispensing unit features first and second sidewalls having ledges which define a plurality of separated rearwardly-directed paths, a receiving bin area, and a forwardly-directed path from the receiving bin area for products to be stored and dispensed. The rearwardly-directed paths have a downward slope oriented from the front to the rear of the dispensing unit. The forwardly-directed path has a downward slope extending from the back to the front of the dispensing unit.

Products, such as cylindrical cans, are loaded on a forward portion of the rearwardly-directed paths. The forwardly-directed path is positioned underneath the rearwardly-directed paths. The rearward portion of the forwardly-directed path forms the product receiving bin area, which is located beneath the terminal portions of the rearwardly-directed paths. The products from the plurality of separated rearwardly-directing paths are advanced towards the rear of the dispensing unit and fall off the terminal portions of the ledges into the receiving bin. The products from different rearwardly-directed paths are interspersed with each other as they fall from the ledges into the product receiving bin area. The dispensing unit then moves the combined products along the forwardly-directed path.

The dispenser is adapted so that the mixed products fall into two interleaved staggered rows along the forwardly-directed path with products in the upper row resting in spaces between two adjacent products in the lower row. A stop located at the most forward portion of the forwardly-directed path prevents further movement of the products. In the area surrounding the stop, the dispenser is free of obstructions which provides a dispensing region where consumers can easily access the products.

When the dispenser is loaded, the most forward products on the upper and lower rows are in the dispensing region. The dispenser is adapted to position the most forward product in the upper row more rearward than the most forward product in the lower row. When both the upper and lower rows have products in the dispensing region, the forward-most product in the upper row partially overlies the most forward product on the lower row; thus only the product in the upper row is directly accessible to the consumer. When the product in the upper row is taken by the consumer, the other products on the upper and lower rows remain stationary. At that juncture, only the most forward product on the lower row is in the dispensing region and accessible to the user. Once the user takes the most forward product from the lower row, both the lower and upper rows advance so that new products are advanced into the dispensing region.

Accordingly, the products accessible at the dispensing region alternate between those of the upper and lower row. The alternating distribution of products from the forwardly-directed path causes the products from each separated rearwardly-directed path to be dispersed in a uniform manner.

The front lower edge of the dispenser can be extended so that there is adequate room between the most forward product on the upper row and the front edge to accommodate an additional product positioned forwardly of the most forward product on the upper row and supported upon the most forward product on the lower row and against the extended front lower edge. This allows a consumer to place a product back into the dispensing region after it has been dispensed even if there are products on both the upper and lower rows in the dispensing region. The product placed back will be in the most forward position in the dispensing region, making it the most accessible product and helping insure that it is again first removed from the dispenser.

The front facing portion of the front lower edge of the dispenser may have a surface to receive a price tag or other informational materials and retaining means to retain the price tag to the front lower edge so that the price tag may be easily viewed by a consumer.

The sidewalls of the dispensing unit have bosses which receive divider rods which secure the sidewalls to each other. The bosses are adapted to receive divider rods of a variety of lengths. Accordingly, the width of the paths can be adjusted so that the path is the approximate width (typically can height) of the product. Multiple dispensing units may be assembled adjacent each other by attaching ledges on both sides of the sidewalls and attaching them to additional sidewalls by connecting divider rods into the bosses.

DESCRIPTION OF THE DRAWINGS

The above and other objects, features and advantages of the present invention will become apparent from the following description of a preferred but, nonetheless, illustrative embodiment of the invention, taken in conjunction with the accompanying drawings, wherein.

DETAILED DESCRIPTION OF PREFERRED EMBODIMENTS

Figure 1:
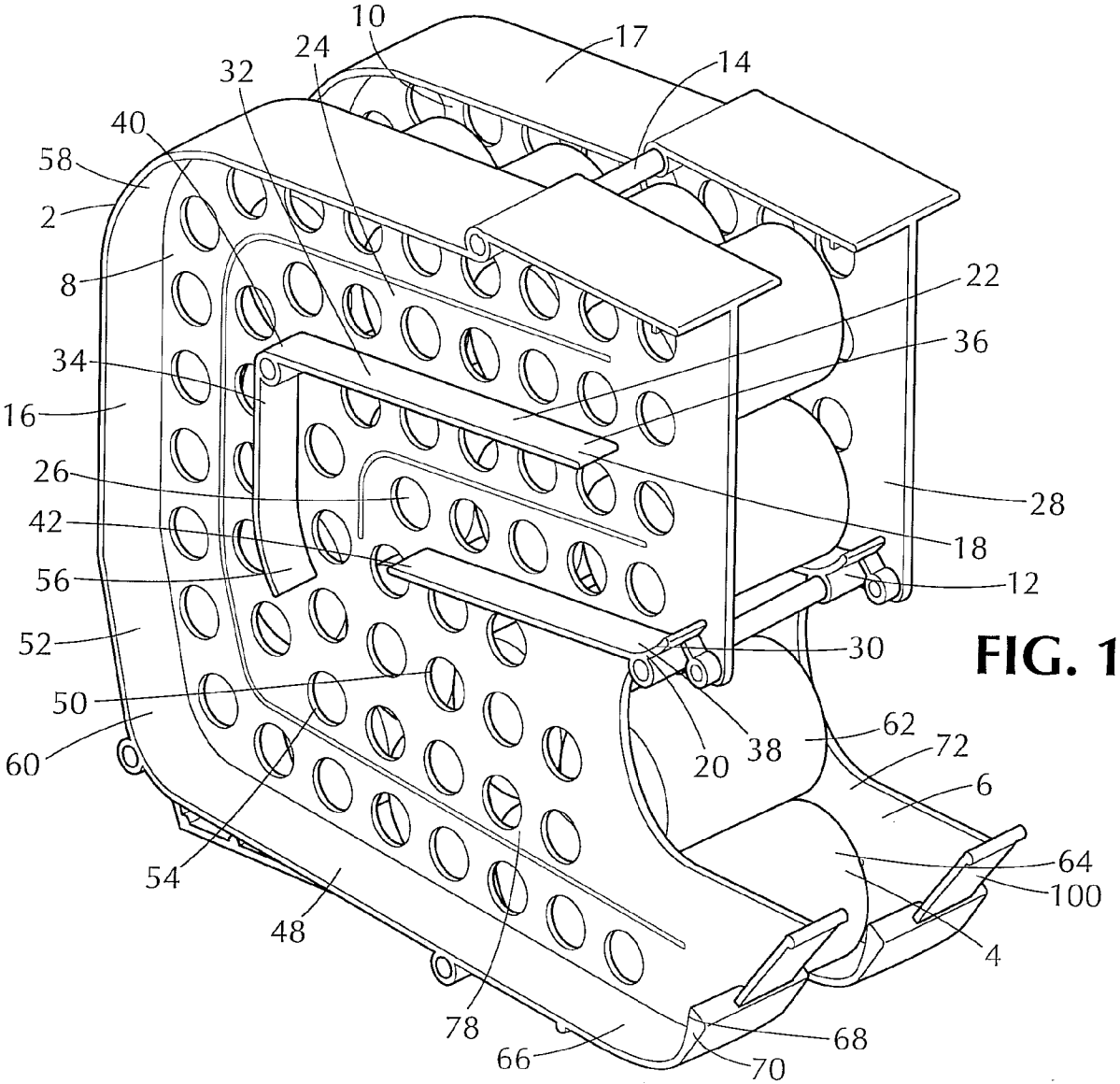
FIG. 1 provides a perspective view of the gravity-fed storage and dispensing unit.

With particular reference to the drawings, the present invention is directed to an improved gravity-fed storage and dispensing unit. FIG. 1 illustrates a gravity-fed storage and dispensing unit 2 having products 4 stored therein and a dispensing region 6 where products are accessible to the consumer.

The dispensing unit 2 comprises first 8 and second 10 spaced sidewalls. The sidewalls 8, 10 have a plurality of bosses 12 to receive divider rods 14 which secure the sidewalls to each other. It is preferred that the bosses 12 are adapted to receive interchangeable divider rods 14 of varying lengths. Therefore, the space between the dispensing unit 2 can be adjusted to accommodate products of a variety of sizes. A ledge forming a backwall 16 is located at the rear edge of each of the sidewalls 8, 10. A ledge forming a topwall 17 is located on the top edge of each of the sidewalls 8, 10.

The sidewalls 8, 10 may have opposing ledges 18 on each side. For instance, in FIG. 1, the first sidewall 8 has ledges 18 on its exterior surface as well as on its inner surface. The ledges 18 typically are formed integrally with the sidewalls, although they also may be secured to the sidewalls 8, 10 by fastening devices well known in the art. The ledges may also be adjustably secured to the sidewalls to allow for adjustments of the positioning of the ledges. Generally, when ledges are formed on each side of a sidewall it is preferred that the ledges on each sidewall are identical to each other. In such a case the backwall ledge 16 and topwall ledge 17 extend on both sides of the sidewall. While the compact nature of ledges is preferred, it is also contemplated that shelves may be used on top of the ledges or in place of the ledges.

Figure 2:
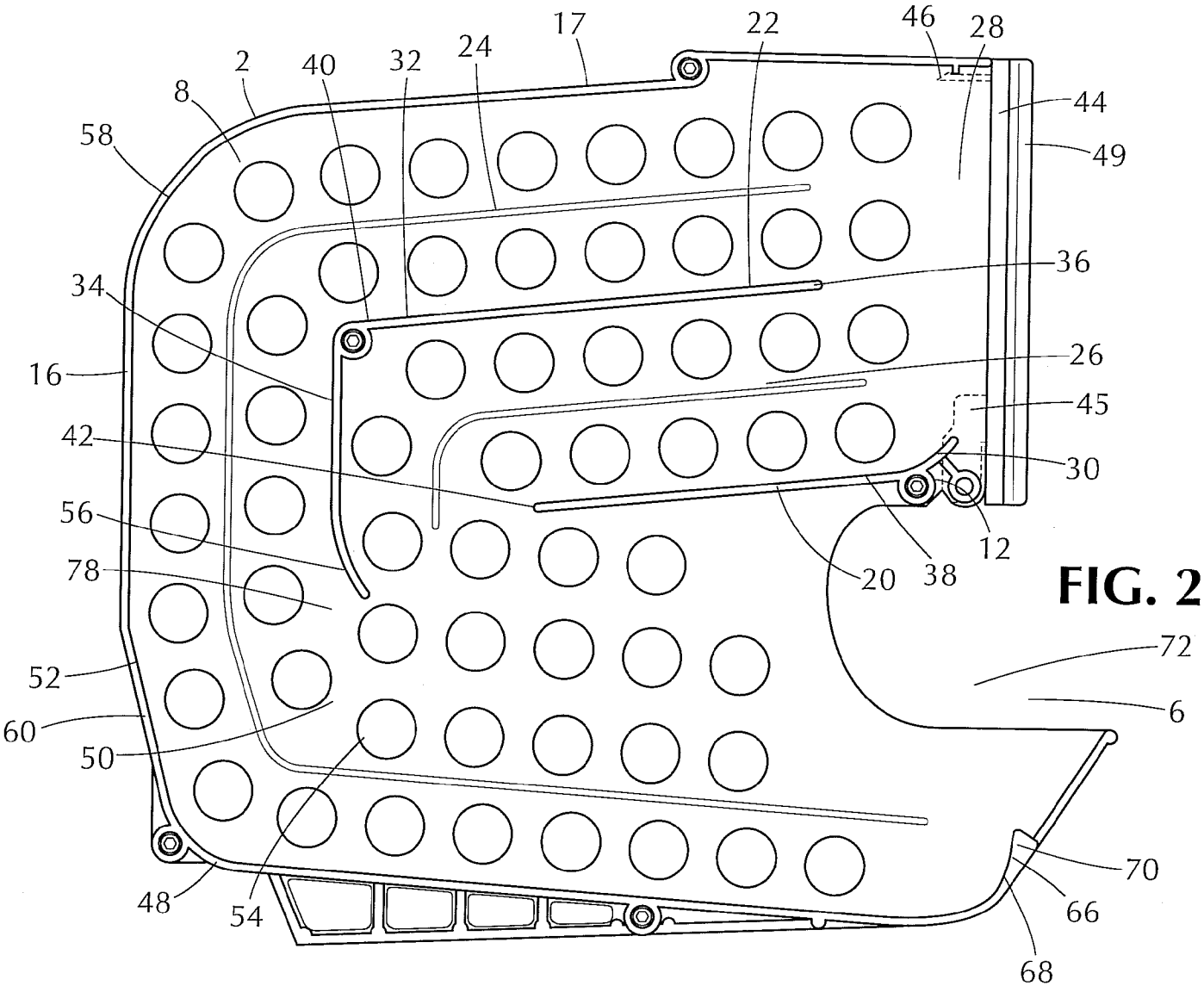
FIG. 2 provides a side view of a sidewall of the gravity-fed storage and dispensing unit with a cover on the top front end of the dispenser.
Figure 3:
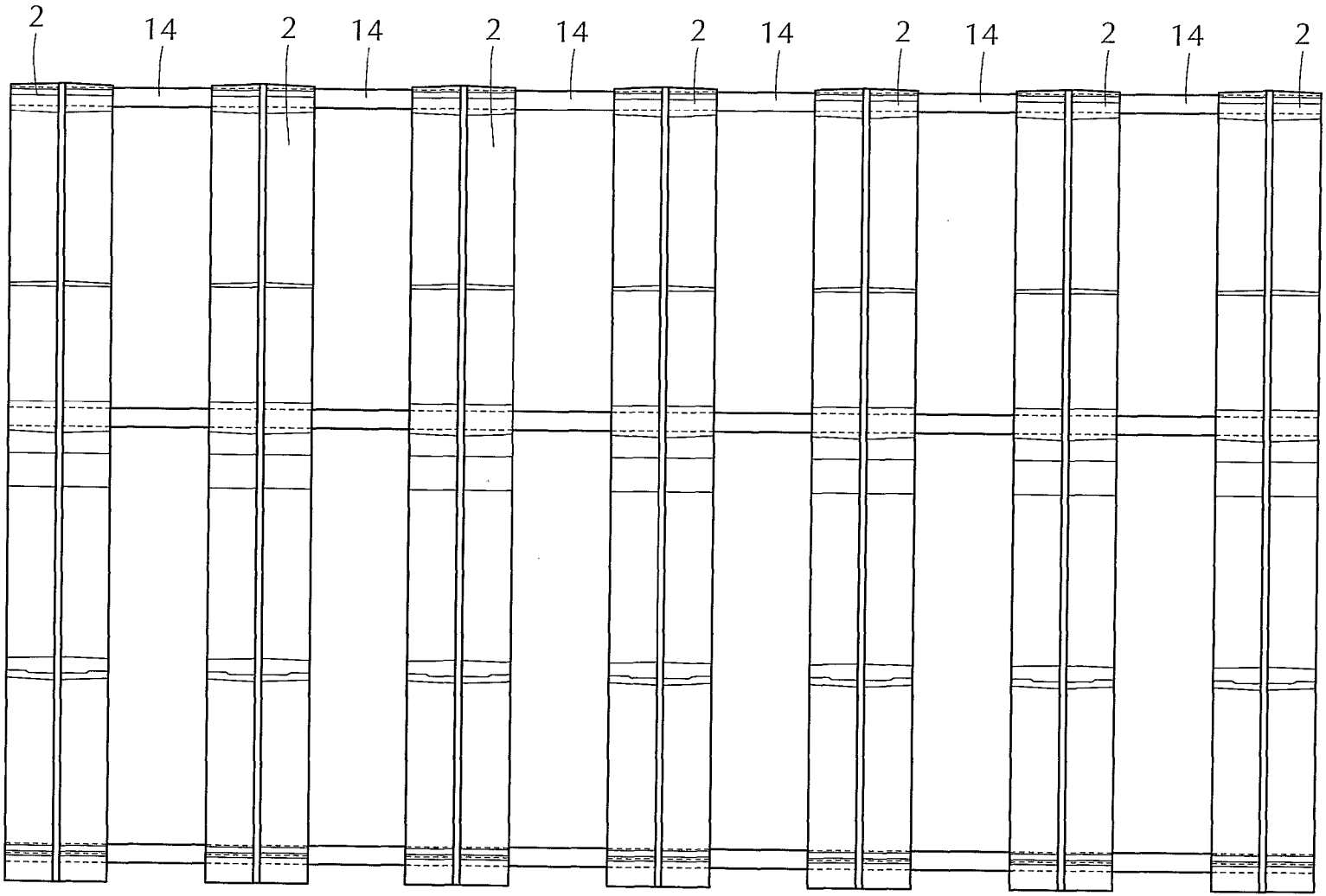
FIG. 3 provides a top plan view of a plurality of gravity-fed storage and dispensing units adjacent to each other.
Figure 4:
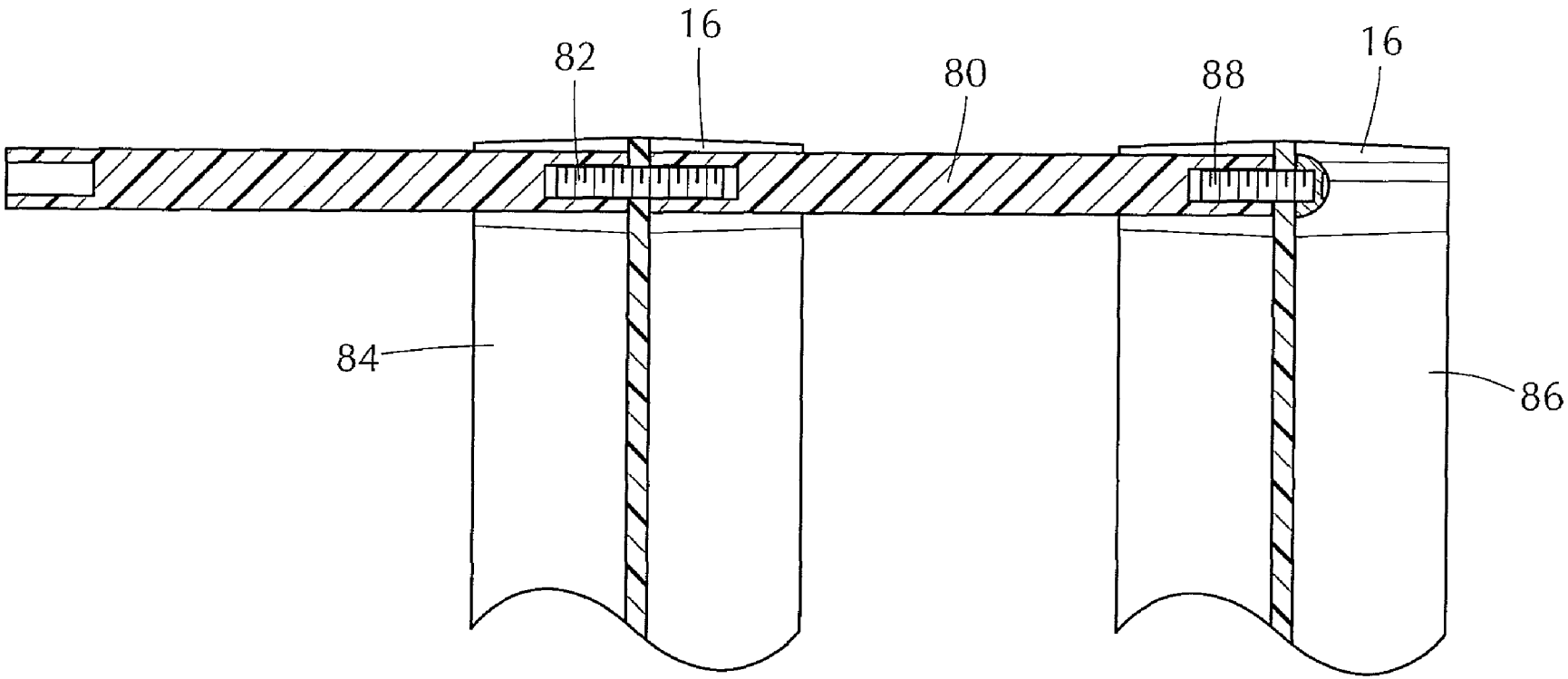
FIG. 4 provides a partially sectional top plan view of a portion of an assembly having an array of dispensing units, which is illustrative of a series of bosses and divider rods which attach the units to each other.

As shown in FIGS. 1 and 2, when assembled into a dispensing unit by the divider rods 14 the sidewalls 8, 10 each have first and second inwardly-facing opposed ledges 20, 22 which define an upper and lower rearwardly-directed path 24, 26. The lower rearwardly-directed path 26 is defined by the first opposed ledges 20 which the products rests upon and the lower surfaces of the second opposed ledges 22 which act as a barrier, restraining the products in the lower rearwardly-directed path from moving into the upper rearwardly-directed path. The upper rearwardly-directed path 24 is defined by the second opposed ledges 22 which the products rest upon and the topwall 17 which maintains the products within the upper rearwardly-directed path. While the ledges on the inner surface of the sidewalls 8, 10 are not visible in FIG. 1, for illustrative purposes, the ledges 18 on the exterior surface of the first sidewall 8 are shown as being identical to those on the inner face of the sidewalls which are holding the products 4.

The first and second opposed ledges 20, 22 extend on a decline from the front to the back of the dispensing unit which gives the paths downward slopes. The downward slopes enable products loaded onto the rearwardly-directed paths 24, 26 to be directed by gravity from the front end to the back end of the paths. While the embodiment shown has two rearwardly-directed paths, additional ledges 18 may be provided to define a plurality of additional rearwardly-directed paths.

Products are loaded onto the rearwardly-directed paths at the front portion of the rearwardly-directed paths. In the embodiment shown, the loading area 28 comprises an opening on the upper portion of the front of the dispensing unit.

As shown in FIG. 2, a cover may be provided, mountable in slots or otherwise, to close the top front end of the dispenser and shield the products on the ledges 20, 22 from view. The cover can be removed or pivoted to offer access to the ledges 20, 22 for product restocking.

Figure 5:
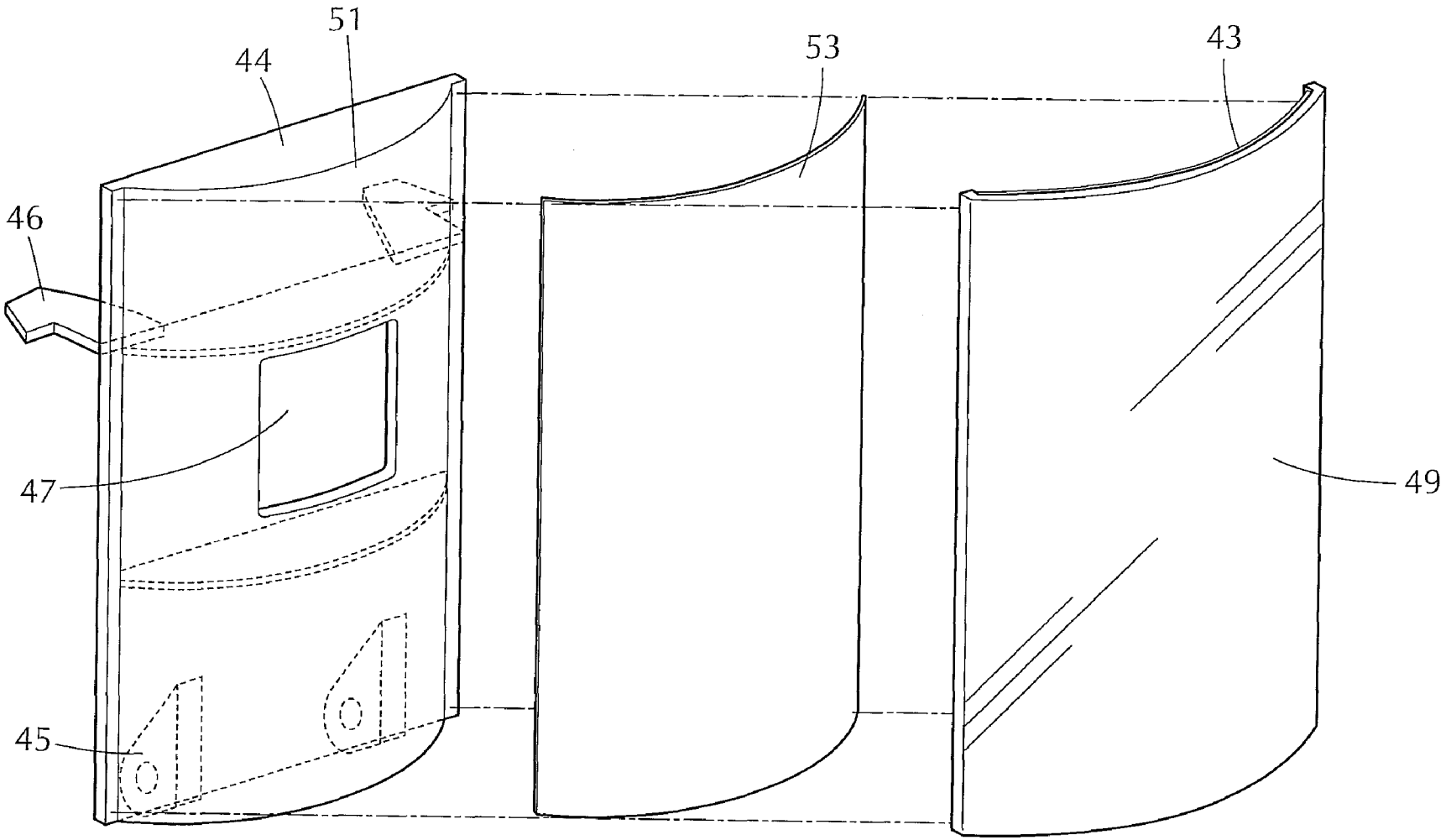
FIG. 5 provides an exploded view of a cover for the top front end of the dispensing unit.

In the embodiment shown in FIG. 5, the cover 44 comprises a rectangular member that has hinges 45 on the lower portion of its back side for attaching to the top front end of the dispenser 2. The upper portion of the back side of the cover 44 has flexible tabs 46 for removably securing the top portion of the cover to the front end of the dispenser so that the cover may be easily opened or closed. The middle portion of the cover 44 has a rectangular aperture 47. A transparent protecting member 49 is attached to the cover 44 and extends over the entire front side of the cover. The transparent protecting member 49 is adapted to leave a small slot 51 between the transparent protecting member 49 and the cover 44. An insert 53 comprising promotional or informational material concerning the product may be placed within the slot 51 and is easily viewed by customers through the transparent protecting member. The top rear edge of the transparent protecting member has a flange 43 to retain the insert 53 within the slot 51 when the cover 44 is opened. The aperture 47 in the cover allows the user to contact the back side of the insert 53 when the cover 44 is opened and slide the insert out of the slot 51. This cover 44 allows for an improved presentation of the products 2 within the dispenser 4.

The first opposed ledge 20 has an upturned forward lip 30 at its forward end 38 to help direct the loaded products onto the lower rearwardly-directed path and to prevent products from inadvertently falling out of the dispensing unit 2. The first opposed ledge 20 extends substantially straight on a decline.

Returning to FIGS. 1 and 2, second opposed ledge 22 is positioned above the first opposed ledge 20. The second opposed ledge 22 is L-shaped, with the top surface of the long arm 32 of the second opposed ledge providing the resting surface for products on the upper rearwardly-directed path 24 and a barrier restraining products 4 on the upper rearwardly-directed path 24 and lower rearwardly-directed path 26 from mixing with each other. The first and second opposed ledges 20, 22 are substantially parallel to each other and are in an offset relationship: the forward end 36 of the second opposed ledge 22 is positioned rearwardly from the forward end 38 of the first opposed ledge 20 to facilitate loading of the lower path; the rear end of the second ledge 40 is positioned more rearwardly than the rear end of the first opposed ledge 42. The offset relationship between the rear of first and second opposed ledges 20, 22 causes the termination of the upper rearwardly-directed path 24 to be more rearward than the termination of the lower rearwardly-directed path 26. While it is generally desired that first and second opposed ledges 20, 22 are parallel to each other, there are certain instances where it may be desirable for one of the ledges to be positioned at a greater or lesser decline than the other opposed ledge.

Each of the sidewalls 8, 10 also carries a third opposed ledge 48 below the first and second opposed ledges 20, 22 which defines a forwardly-directed product path 50. As shown in FIGS. 1-2, the third opposed ledge 48 may be integral with the backwall 16 and topwall 17. The rear portion of the third opposed ledge 52 lies below and behind the terminal portions of the rear end of the first and second opposed ledges and forms a receiving bin area 54. Products 4 from the upper and lower rearwardly-directed paths fall into the receiving bin area 54 in a generally interdigitated manner and collect along the forwardly-directed path 50. In order to help move products from the lower rearwardly-directed path 26 to the product receiving bin area 54, the short arm 34 of the L-shaped second opposed ledge may have a downward, forward sloping lower edge 56. To help move products from the upper rearwardly-directed path 24 to the product receiving bin area 54, a forwardly-directed exterior surface contoured to provide a rounded decline 58 may be formed in the upper region of the back wall 16 and rear side of the topwall 17 in an area on the top portion of the upper rearwardly-directed path 24. The products from the separated upper and lower rearwardly-directed paths 24, 26 become interspersed with each other as they are simultaneously sent into the receiving bin area 54 and placed onto the forwardly-directed path 50.

The third opposed ledge 48 is oriented on a decline from the back to the front of the dispensing unit 2 which gives the forwardly-directed path 50 a downward slope. The downward slopes enable products 4 loaded onto the forwardly-directed path 50 to be led by gravity from the rear end to the front end of the path. The third opposed ledge 48 has a sharp decline 60 at its rear end to facilitate the advancement of products 4 from the upper rearwardly-directed path 24, and to a lesser extent the lower rearwardly-directed path 26, along the forwardly-directed path 50.

As the products fall from the rear of the two rearwardly-directed paths into the receiving bin area 54, they intersperse with each other and can form a two row alternating stack of products, as shown in FIG. 1.

The ledges 18 of the dispenser unit 2 position the products 4 along the forwardly-directed path 50 in an interdigitated upper 62 and lower 64 row. Products in the upper row 62 rest in the spaces between adjacent products in the lower row 64. The forward end 66 of the forwardly-directed path has a sharply upwardly inclined slope portion 68 formed in the ledges 48 which forms a stop 70. The stop 70 prevents further forward travel of the products in the lower row 64 and thus also controls the forward motion of the products in the interdigitated upper row 62, preventing all products from falling out of the dispensing unit 2. The forward end 66 of the forwardly directed path helps form a dispensing region 6. The dispensing region 6 has an open area 72 above it so that consumers can easily access the products therein.

When the dispensing unit 2 is loaded, the most forward products on the upper 62 and lower 64 rows are positioned in the dispensing region 6. The most forward product in the upper row 62 is positioned more rearward than the most forward product in the lower row 64, as shown in FIG. 1. When both the upper and lower rows 62, 64 have a product in the dispensing region 6, the forward end 66 of the forwardly-directed path and the product on the upper row surrounds and obstruct free access to the most forward product on the lower row; only the product in the upper row within the dispensing region 6 is easily accessible to the consumer. When the product in the upper row 62 in the dispensing region 6 is taken by the consumer, the other products 4 remain stationary. At that juncture, only the most forward product on the lower row 64 is in the dispensing region 6 and only that product is accessible to the consumer. Once the consumer takes the most forward product from the lower row 64, both the upper and lower rows 62, 64 advance forwardly so that new products in the upper and lower rows move into the dispensing region 6.

Accordingly, the products 4 accessible at the dispensing region alternate between those of the upper 62 and lower 64 rows. The alternating distribution of products from the forwardly-directed path 50 causes the products from each separated rearwardly-directed path 24, 26 to be dispersed in a uniform manner.

The inclined front edge portion of the forward directed path 68 can be extended above stop 70 at 100 so that there is additional room between the most forward product on the upper row 62 and the extended stop 70 to hold an additional product. This allows a consumer to place a product 4 back into the dispensing region 6 after it has been dispensed, even if there are products on both the upper and lower rows 62, 64 in the dispensing region. The additional product in the dispensing region 6 will be in the most forward position in the dispensing region and will be the most accessible product, allowing it to be re-distributed first.

Figure 6:
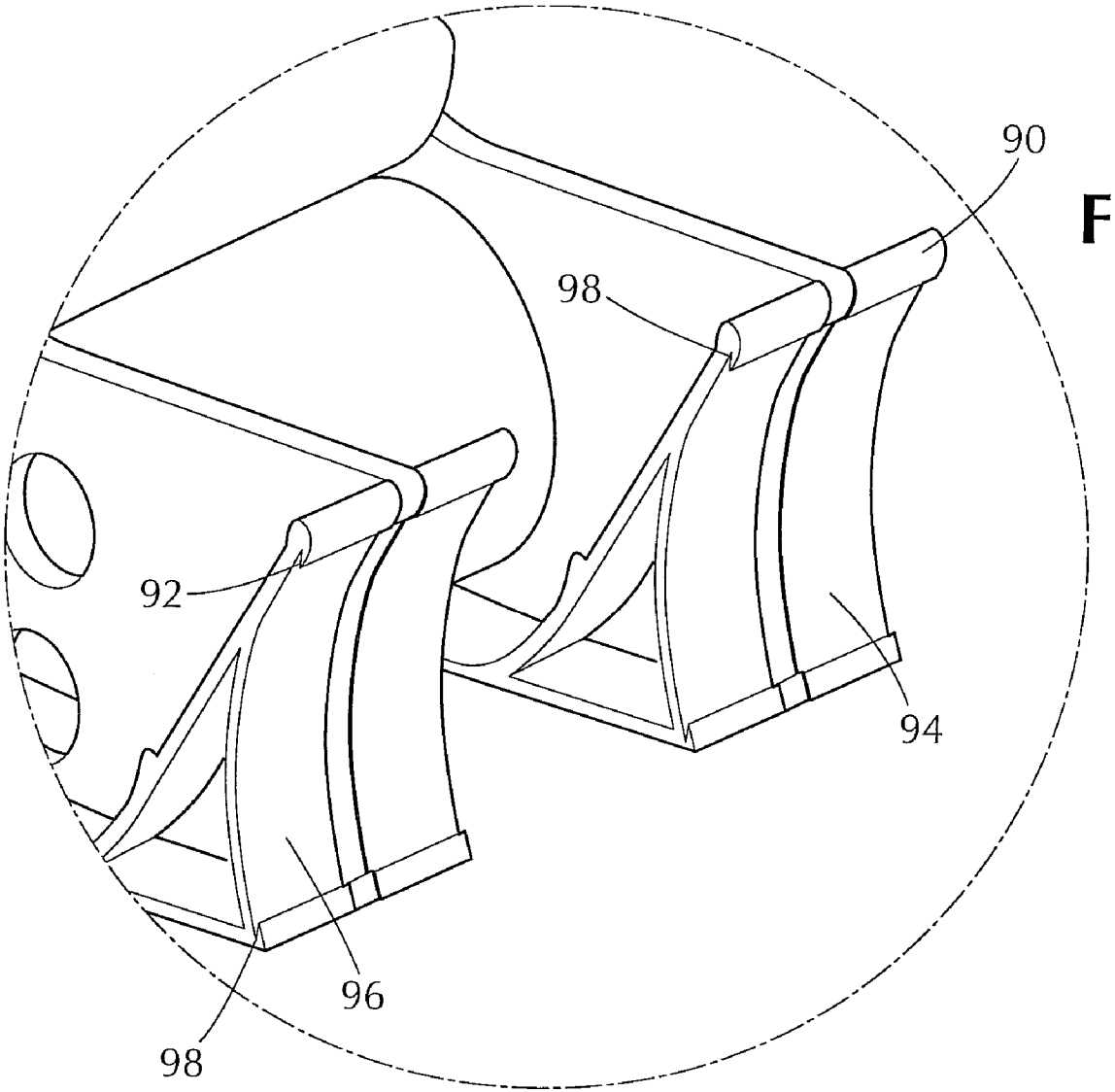
FIG. 6 is a magnified perspective view of the front lower edge of the dispenser being adapted to display informational material.

The front facing portion 90 of the front lower edge of the dispenser 2 may have a surface to receive a price tag or other informational materials and retaining means 92 to retain the price tag to the front lower edge so that a consumer may easily view the price tag. In the embodiment shown in FIG. 6, the front facing portion comprises two laterally spaced members 94, 96 that are curved inwardly and have an aperture between them. The laterally spaced members 94, 96 each have retaining means comprising upper and lower grooves 98 for receiving an edge of the price tag.

I claim:

1. A gravity-fed storage and dispensing unit comprising:

first and second spaced sidewalls, each of said sidewalls having a first generally horizontal downward rearwardly sloping ledge defining a lower rearwardly directed path for products placed thereon; a second generally L-shaped ledge having a generally horizontal downward rearwardly sloping portion above the rearwardly sloping portion of the first ledge and a generally vertical rear portion, said second ledge defining an upper rearwardly directed path for products placed thereon, the vertical rear portion being located rearwardly of a rear end of the first ledge and forming a barrier for products on the first ledge;

each of the first and second sidewalls further having an opposed third ledge below the first and second ledges defining a forwardly directed path for products received from the first and second ledges;

the vertical rear portion of the second ledge forming a forward wall for a generally vertical fall portion of the upper product path and forming a rearward wall for a generally vertical fall portion of the lower product path whereby the vertical fall portions are separate and parallel to each other;

rear portions of the third ledges forming a product receiving bin area for the vertical fall portions and forward portions forming a product dispensing region with forward ends of the third ledges defining a stop to restrain products on the third ledges in the product dispensing region:

said first ledges and third ledges being spaced sufficiently apart along their lengths to accommodate two rows of interdigitated product extending from said receiving bin to said forward ends of the third ledges;

the first and second fall portions and receiving bin area being constructed and aligned such that products passing therethrough fall into said product receiving bin area and collect in two interdigitated stacked rows of product extending to the forward ends of said third ledges for dispensing:

said forward ends of the third ledges having an extended ledge portion extending upwardly and forwardly from said stop which form an exposed forward end of a reception area for returned product, the reception area projecting forwardly of the forward ends of the first and second ledges, wherein the extended ledge portion comprises a substantially rectangular member positioned on a middle portion of the forward end of each of the opposed third ledges, the extended ledge portion having a width that is narrower than the width of the end of the opposed third ledge.

2. The gravity fed storage and dispensing unit of claim 1 wherein the first ledge is spaced above the third ledge sufficiently to allow products to assume the interdigitated arrangement.

3. The gravity fed storage and dispensing unit of claim 1 wherein the vertical rear portion of the second ledge has a lower forwardly-directed portion for directing falling product of the lower path to fall forwardly.

4. The gravity-fed storage and dispensing unit of claim 1 wherein said sidewalls have bosses to accept divider rods to connect said sidewalls together in a spaced relationship.

5. The gravity-fed storage and dispensing unit of claim 4 wherein said bosses are adapted to receive said divider rods of varying sizes so that the distance between said sidewalls can be adjusted.

6. The gravity-fed storage and dispensing unit of claim 1 wherein the rear portions of said opposed third ledges include an upwardly curved portion.

7. The gravity-fed storage and dispensing unit of claim 1 wherein said first ledges have upwardly directed forward end portions for acceptance of product.

8. The gravity-fed storage and dispensing unit of claim 1 wherein a rear edge of each of said sidewalls has a ledge which forms a product guidance backwall.

9. The gravity-fed storage and dispensing unit of claim 8 wherein a ledge located on the top edge of each of said sidewalls forms a topwall, said topwall providing a barrier for products on said upper rearwardly directed path thereby further defining said upper rearwardly directed path.

10. The gravity-fed storage and dispensing unit of claim 9 wherein an upper region of said back wall and a rear side of said topwall include a forwardly directed exterior surface contoured to provide a rounded decline guiding products on said second opposed downward sloping ledges into the receiving bin area.

11. The gravity-fed storage and dispensing unit of claim 1 wherein a front facing portion of a front lower edge of said dispensing unit comprises a display surface to receive informational material and retaining means to retain said informational material upon said display surface.

12. The gravity-fed storage and dispensing unit of claim 1 wherein the first fall portion further comprises means for depositing products loaded upon the lower path upon a row of previously deposited products on the third ledges such that such further deposited products lie in interdigitated positions upon two adjacent products of the row of previously deposited products.

13. The gravity-fed storage and dispensing unit of claim 1 wherein said reception area formed by said extended ledge portion comprises a space above and forward of a lower row of interdigitated products in the dispensing region and forward of an upper row of interdigitated products and is dimensioned to accept a returned product whereby the returned product rests against the extended ledge portion and upon a most forward product of said lower row of interdigitated products.

14. A gravity-fed storage and dispensing unit comprising:

first and second spaced sidewalls, each of said sidewalls having a first generally horizontal downward rearwardly sloping ledge defining a lower rearwardly directed path for products placed thereon; a second ledge having a generally horizontal downward rearwardly sloping portion above the rearwardly sloping portion of the first ledge, said second ledge defining an upper rearwardly directed path for products placed thereon;

each of the first and second sidewalls further having an opposed third ledge below the first and second ledges defining a forwardly directed path for products received from the first and second ledges;

forward portions of the third ledges forming a product dispensing region with forward ends of the third ledges defining a stop at a forward end of the product dispensing region to restrain products on the third ledges in the product dispensing region;

said forward ends of the third ledges having an extended ledge portion extending upwardly and forwardly from said stop which form an exposed forward end of a reception area for returned product, the reception area projecting forwardly of the forward ends of the first and second ledges, wherein the extended ledge portion comprises a substantially rectangular member positioned on a middle portion of the forward end of each of the opposed third ledges, the extended ledge portion having a width that is narrower than the width of the end of the opposed third ledge.

15. The gravity-fed storage and dispensing unit of claim 14 wherein said reception area formed by said extended ledge portion comprises a space above and forward of a lower row of interdigitated products in the dispensing region and forward of an upper row. of interdigitated products and is dimensioned to accept a returned product whereby the returned product rests against the extended ledge portion and upon a most forward product of said lower row of interdigitated products.

* * * * *